US009024823B2

(12) United States Patent
Bevelacqua

(10) Patent No.: US 9,024,823 B2
(45) Date of Patent: May 5, 2015

(54) DYNAMICALLY ADJUSTABLE ANTENNA SUPPORTING MULTIPLE ANTENNA MODES

(75) Inventor: Peter Bevelacqua, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 125 days.

(21) Appl. No.: 13/118,276

(22) Filed: May 27, 2011

(65) Prior Publication Data

US 2012/0299785 A1 Nov. 29, 2012

(51) Int. Cl.

| | |
|---|---|
| ***H01Q 21/30*** | (2006.01) |
| ***H01Q 1/24*** | (2006.01) |
| ***H01Q 5/00*** | (2006.01) |
| ***H01Q 9/42*** | (2006.01) |
| ***H01Q 13/10*** | (2006.01) |

(52) U.S. Cl.

CPC ..... *H01Q 1/243* (2013.01); *H01Q 5/0037* (2013.01); *H01Q 9/42* (2013.01); *H01Q 13/10* (2013.01)

USPC ..... 343/702; 343/745; 343/861; 343/725

(58) Field of Classification Search

CPC ..... H01Q 13/10; H01Q 1/243; H01Q 5/0037; H01Q 9/42

USPC ..... 343/702

See application file for complete search history.

(56) References Cited

U.S. PATENT DOCUMENTS

| | | | | |
|---|---|---|---|---|
| 6,515,625 | B1 | 2/2003 | Johnson | |
| 6,864,848 | B2 * | 3/2005 | Sievenpiper | 343/767 |
| 7,164,387 | B2 * | 1/2007 | Sievenpiper | 343/702 |
| 7,215,283 | B2 * | 5/2007 | Boyle | 343/700 MS |
| 7,420,511 | B2 * | 9/2008 | Oshiyama et al. | 343/700 MS |
| 7,439,911 | B2 | 10/2008 | Wang | |
| 7,595,759 | B2 | 9/2009 | Schlub et al. | |
| 7,612,725 | B2 | 11/2009 | Hill et al. | |
| 7,626,551 | B2 | 12/2009 | Chien et al. | |
| 7,808,438 | B2 | 10/2010 | Schlub et al. | |

(Continued)

FOREIGN PATENT DOCUMENTS

| | | |
|---|---|---|
| EP | 2328233 | 1/2011 |
| JP | S58-104504 | 6/1983 |

(Continued)

OTHER PUBLICATIONS

Antenna Theory: A Review, Balanis, Proc. IEEE vol. 80 No. 1 Jan. 1992.*

(Continued)

*Primary Examiner* — Robert Karacsony
*Assistant Examiner* — Amal Patel
(74) *Attorney, Agent, or Firm* — Treyz Law Group; G. Victor Treyz; Michael H. Lyons

(57) ABSTRACT

Electronic devices may be provided that contain wireless communications circuitry. The wireless communications circuitry may include radio-frequency transceiver circuitry coupled to an adjustable antenna. The adjustable antenna may contain conductive antenna structure such as conductive electronic device housing structures. Electrical components such as switches and resonant circuits may be used in configuring the antenna to operate in two or more different antenna modes at different respective communications bands. Control circuitry may be used in controlling the switches. The antenna may be configured to operate as an inverted-F antenna in one mode of operation and a slot antenna in a second mode of operation.

8 Claims, 12 Drawing Sheets

(56) References Cited

U.S. PATENT DOCUMENTS

| | | | | |
|---|---|---|---|---|
| 7,843,396 | B2 | 11/2010 | Hill et al. | |
| 7,893,883 | B2 | 2/2011 | Schlub et al. | |
| 7,898,485 | B2 | 3/2011 | Schlub et al. | |
| 7,924,231 | B2 | 4/2011 | Hill et al. | |
| 8,094,079 | B2 | 1/2012 | Schlub et al. | |
| 2003/0122721 | A1 | 7/2003 | Sievenpiper | |
| 2003/0222823 | A1 | 12/2003 | Flint et al. | |
| 2004/0222926 | A1 | 11/2004 | Kontogeorgakis et al. | |
| 2005/0007291 | A1 | 1/2005 | Fabrega-Sanchez et al. | |
| 2006/0097918 | A1 | 5/2006 | Oshiyama et al. | |
| 2008/0165065 | A1 | 7/2008 | Hill et al. | |
| 2008/0238794 | A1 | 10/2008 | Pan et al. | |
| 2009/0231215 | A1* | 9/2009 | Taura | 343/702 |
| 2010/0085260 | A1 | 4/2010 | McKinzie et al. | |
| 2010/0123632 | A1* | 5/2010 | Hill et al. | 343/702 |
| 2010/0238079 | A1 | 9/2010 | Ayatollahi et al. | |
| 2010/0253538 | A1 | 10/2010 | Smith | |
| 2010/0295737 | A1 | 11/2010 | Milosavljevic et al. | |
| 2011/0183721 | A1 | 7/2011 | Hill et al. | |
| 2011/0193754 | A1 | 8/2011 | Schlub et al. | |

FOREIGN PATENT DOCUMENTS

| | | |
|---|---|---|
| JP | H04-014305 | 1/1992 |
| JP | 09093029 | 4/1997 |
| JP | 2000332530 | 11/2000 |
| JP | 2005159813 | 6/2005 |
| JP | 2005167730 | 6/2005 |
| TW | 200713695 | 4/2007 |
| WO | 02054534 | 7/2002 |
| WO | 2007012697 | 2/2007 |
| WO | 2008012697 | 1/2008 |
| WO | 2011050845 | 5/2011 |

OTHER PUBLICATIONS

Hill et al., U.S. Appl. No. 13/286,612, filed Nov. 1, 2011.
Jin et al., U.S. Appl. No. 13/041,934, filed Mar. 7, 2011.
Jin et al., U.S. Appl. No. 13/041,905, filed Mar. 7, 2011.
Mow et al., U.S. Appl. No. 12/831,180, filed Jul. 6, 2011.
Bae et al., "Compact PIFA / Slot Antenna for Quad-Band Mobile Handset Applications" 2009.

* cited by examiner

DYNAMICALLY ADJUSTABLE ANTENNA SUPPORTING MULTIPLE ANTENNA MODES

BACKGROUND

This relates generally to electronic devices, and, more particularly, to wireless communications circuitry and antennas for electronic devices.

Electronic devices such as portable computers and cellular telephones are often provided with wireless communications capabilities. For example, electronic devices may use long-range wireless communications circuitry such as cellular telephone circuitry and WiMax (IEEE 802.16) circuitry. Electronic devices may also use short-range wireless communications circuitry such as WiFi® (IEEE 802.11) circuitry and Bluetooth® circuitry.

It can be challenging to implement antenna structures in wireless electronic devices. For example, portable electronic devices are often limited in size, which may restrict the amount of space available for implementing antenna structures. Some portable electronic devices contain conductive structures such as conductive housing structures, display structures, and printed circuit boards. There is often a desire to provide antennas that cover a variety of communications bands, but this can be difficult in environments where space is limited and in which antenna structures are located in the vicinity of conductive structures.

It would therefore be desirable to be able to provide improved antenna structures for wireless electronic devices.

SUMMARY

Electronic devices may be provided that contain wireless communications circuitry. The wireless communications circuitry may include radio-frequency transceiver circuitry coupled to an adjustable antenna. The radio-frequency transceiver circuitry may be used in transmitting and receiving radio-frequency signals through the adjustable antenna.

A control circuit in the electronic device may be used to make dynamic adjustments to the antenna to support operation in different antenna modes. For example, the control circuit may be used to selectively open and close switches in the antenna to tune the antenna as a function of which communications band is being used by the radio-frequency transceiver circuitry. If desired, antenna tuning arrangements may be implemented using passive circuits. For example, an adjustable antenna may include passive circuits such as resonant circuits that change impedance at different operating frequencies and thereby reconfigure the antenna to support different antenna modes at different operating frequencies.

The adjustable antenna may contain conductive antenna structures such as conductive electronic device housing structures. The conductive antenna structures may include a peripheral conductive housing member, internal housing structures, conductive portions of electrical components such as connectors, displays, speakers, microphones, parts of printed circuit boards, or other conductive structures. Electrical components such as switches and resonant circuits may be used in configuring the conductive structures of the adjustable antenna so that they operate as different types of antennas in different antenna modes.

Further features of the invention, its nature and various advantages will be more apparent from the accompanying drawings and the following detailed description of the preferred embodiments.

DETAILED DESCRIPTION

Figure 1:
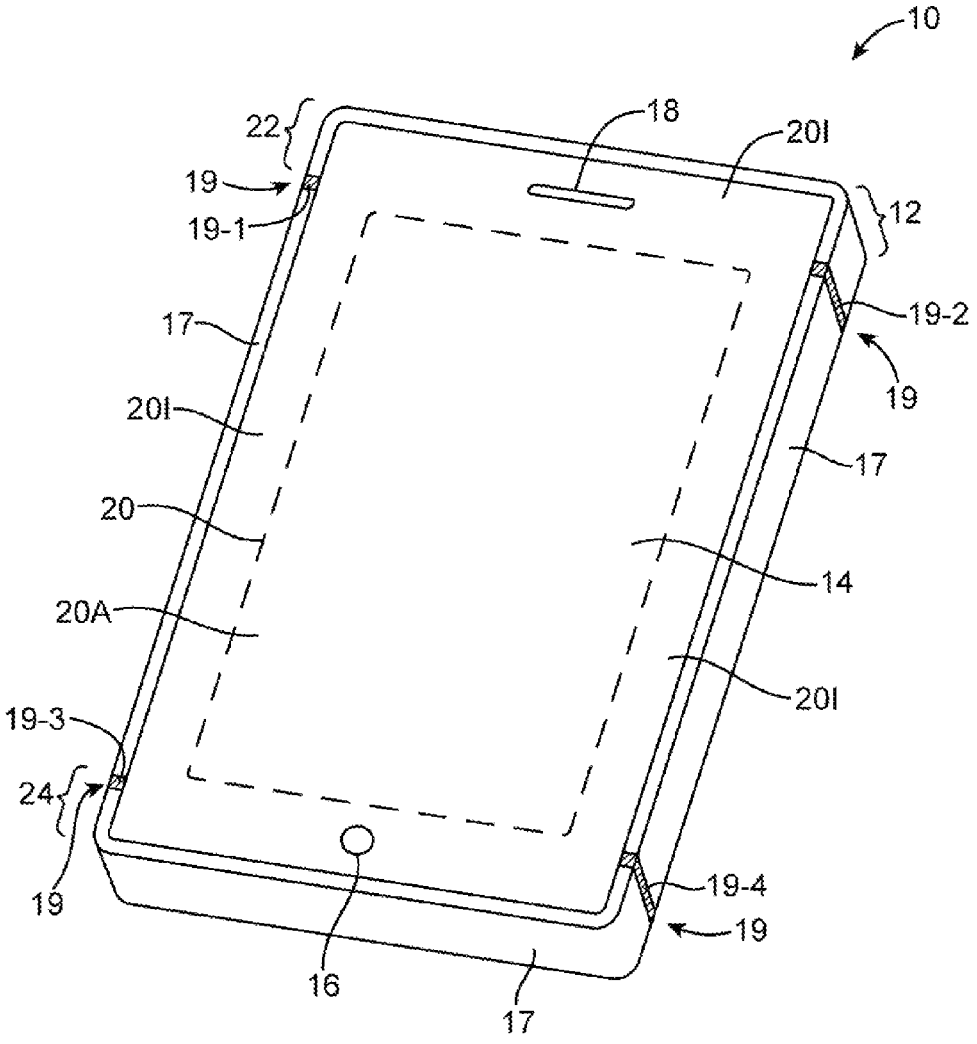
FIG. 1 is a perspective view of an illustrative electronic device with wireless communications circuitry having adjustable antenna structures in accordance with an embodiment of the present invention.

Electronic devices may be provided with wireless communications circuitry. The wireless communications circuitry may include adjustable antenna structures. The adjustable antenna structures may be used to implement one or more adjustable antennas. The adjustable antenna structures may be used in any suitable electronic equipment. The use of adjustable antennas in electronic devices such as portable electronic devices is sometimes described herein as an illustrative example. If desired, the adjustable antenna structures may be implemented in other electronic equipment.

The adjustable antenna structures may be adjusted using actively configured components such as switches. With this type of arrangement, control circuitry within the electronic device may issue control signals depending on which mode of operation is desired. If, for example, a baseband processor, microprocessor, or other control circuitry within the electronic device desires to place the device into a mode in which wireless signals can be handled in a first frequency range, the control circuitry may issue control commands that place one or more switches into a first state. If it is desired to transmit and receive wireless signals in a second frequency range, the control circuitry may issue control commands that place the one or more switches into a second state. The states of the switches determine which portions of the conductive antenna structures are electrically connected to each other, thereby configuring the conductive antenna structures to operate in different antenna modes in different frequency ranges.

If desired, some or all of the antenna structures in the electronic device can be configured using circuitry that exhibits a frequency-dependent impedance. The frequency-dependent-impedance circuitry, which is sometimes referred to as resonant circuitry or filter circuitry, may be coupled between one or more conductive structures that form the antenna structures. When operating at some frequencies, a resonant circuit may exhibit a relatively low impedance and may couple certain antenna structures together. When operating at other frequencies, the resonant circuit may exhibit a relatively high impedance and may electrically isolate those antenna structures. The frequencies of operation at which the resonant circuits exhibit high and low impedances can be configured to allow the adjustable antenna to operate in different antenna modes in different desired communications bands.

Combinations of these arrangements may also be used. For example, antenna structures may be formed that include actively adjusted switches and passively adjusted resonant circuits. At different operating frequencies, the resonant circuits will exhibit different impedances, thereby selectively connecting and disconnecting conductive antenna structures. At the same time, control circuitry may be used to generate control signals for switches that selectively connect and disconnect conductive antenna structures from each other. The antenna structures in device 10 may therefore be adjusted to cover a desired set of frequency bands using passive antenna adjustments (e.g., frequency-dependent adjustments to an antenna by virtue of inclusion of frequency-dependent-impedance circuitry among conductive antenna structures) and/or by using active adjustments to switching circuitry that is coupled between conductive antenna structures.

An illustrative electronic device of the type that may be provided with an antenna that is formed from conductive antenna structures that are coupled together using resonant circuits and/or actively controlled switching circuitry is shown in FIG. 1. Electronic device 10 may be a portable electronic device or other suitable electronic device. For example, electronic device 10 may be a laptop computer, a tablet computer, a somewhat smaller device such as a wristwatch device, pendant device, headphone device, earpiece device, or other wearable or miniature device, a cellular telephone, a media player, larger devices such as desktop computers, computers integrated into computer monitors, or other electronic devices.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material. In other situations, housing 12 or at least some of the structures that make up housing 12 may be formed from metal elements.

Device 10 may, if desired, have a display such as display 14. Display 14 may, for example, be a touch screen that incorporates capacitive touch electrodes or that incorporates a touch sensor formed using other types of touch sensor technology (e.g., acoustic touch sensor technology, light-based touch sensor technology, pressure-sensor-based touch sensor technology, resistive touch sensor technology, etc.). Display 14 may include image pixels formed from light-emitting diodes (LEDs), organic LEDs (OLEDs), plasma cells, electronic ink elements, liquid crystal display (LCD) components, or other suitable image pixel structures. A cover layer such as a layer of cover glass may cover the surface of display 14. Portions of display 14 such as peripheral regions 201 may be inactive and may be devoid of image pixel structures. Portions of display 14 such as rectangular central portion 20A (bounded by dashed line 20) may correspond to the active part of display 14. In active display region 20A, an array of image pixels may be used to display images for a user.

The cover glass layer that covers display 14 may have openings such as a circular opening for button 16 and a speaker port opening such as speaker port opening 18 (e.g., for an ear speaker for a user). Device 10 may also have other openings (e.g., openings in display 14 and/or housing 12 for accommodating volume buttons, ringer buttons, sleep buttons, and other buttons, openings for an audio jack, data port connectors, removable media slots, etc.).

Housing 12 may include a peripheral conductive member such as peripheral conductive housing member 17. Peripheral conductive member 17 may be a bezel that runs around the upper edge of housing 12 around some or all of the periphery of display 14 or may have other shapes. For example, some or all of conductive member 17 may form sidewalls for device 10. The sidewalls may have vertical surfaces that are perpendicular to the surface of display 14 or may have curved or straight surfaces that are oriented at non-perpendicular angles with respect to the planar surface of display 14. With one suitable arrangement, which is sometimes described herein as an example, peripheral conductive member 17 may be formed from a metal band-shaped member that surrounds substantially all of the periphery of rectangular display 14. Peripheral conductive housing member 17 and other conductive structures in device 10 may be formed from conductive materials such as metal. For example, conductive peripheral housing member 17 may be formed from a metal such as aluminum or stainless steel (as examples).

As shown in FIG. 1, peripheral conductive member 17 may, if desired, contain one or more dielectric-filled gaps 19

(e.g., one or more gaps such as gaps 19-1, 19-2, 19-3, and 19-4). Gaps 19 may be filled with dielectrics such as air, plastic, ceramic, glass, or other dielectric materials. In configurations in which one or more gaps 19 are present within peripheral conductive member 17, peripheral conductive member 17 may be divided into respective segments. For example, peripheral conductive member 17 may be divided into a first segment that extends between gaps 19-1 and 19-2, a second segment that extends between gaps 19-2 and 19-3, a third segment that extends between gaps 19-3 and 19-4, and a fourth segment that extends between gaps 19-4 and 19-1. In configurations with additional dielectric-filled gaps, peripheral conductive member 17 may be divided into additional conductive segments. In configurations with fewer gaps 19, peripheral conductive member 17 may be divided into fewer segments (e.g., three or fewer segments, two or fewer segments, or a single segment divided by a single gap). If desired, cosmetic gaps (i.e., structures that contain some dielectric along the surface portions of member 17 but that do not extend completely through member 17 and therefore that do not electrically isolate respective portions of member 17) may be included in peripheral conductive member 17 (e.g., in one or more of the locations shown by gaps 19 of FIG. 2.).

Conductive antenna structures in device 10 (i.e., the conductive structures that are sometimes referred to as forming an antenna or antennas in device 10) may be formed from conductive portions of housing 12 such as one or more portions of peripheral conductive member 17, from one or more internal conductive housing structures such as internal conductive frame members and/or conductive planar structures such as patterned conductive sheet metal structures and associated conductive components (sometimes referred to as forming a midplate member or midplate structures), from conductive traces such as metal traces on rigid printed circuit boards, from conductive traces such as metal traces on flexible printed circuit boards (i.e., "flex circuits" formed from patterned metal traces on flexible sheets of polymer such as polyimide sheets), from conductive traces on plastic carriers (e.g., metal traces on molded plastic carriers), from wires, from patterned metal foil, from conductive structures on other substrates, from other patterned metal members, from conductive portions of electrical components (e.g., switches, display components, connector components, microphones, speakers, cameras, radio-frequency shielding cans, integrated circuits, or other electrical components), from other suitable conductive structures, or from combinations of one or more such conductive structures. In some illustrative arrangements for device 10, which are sometimes described herein as an example, at least some of the conductive structures that form the antenna structures include conductive housing structures such as portions of conductive peripheral housing member 17 and some of the conductive structures that form the antenna structures include ground plane structures such as a conductive housing midplate member, printed circuit board ground structures, and other conductive structures (e.g., conductive portions of electronic components such as connectors, microphones, speakers, displays, cameras, etc.).

Antennas may be located along the edges of device 10, on the rear or front of device 10, as extending elements or attachable structures, or elsewhere in device 10. With one suitable arrangement, which is sometimes described herein as an example, device 10 may be provided with one or more antennas at lower end 24 of housing 12 and one or more antennas at upper end 22 of housing 12. Locating antennas at opposing ends of device 10 (i.e., at the narrower end regions of display 14 and device 10 when device 10 has an elongated rectangular shape of the type shown in FIG. 1) may allow these antennas to be formed at an appropriate distance from ground structures that are associated with the conductive portions of display 14 (e.g., the pixel array and driver circuits in active region 20A of display 14).

If desired, a first cellular telephone antenna (first cellular telephone antenna structures) may be located in region 24 and a second cellular telephone antenna (second cellular telephone antenna structures) may be located in region 22. Antenna structures for handling satellite navigation signals such as Global Positioning System signals or wireless local area network signals such as IEEE 802.11 (WiFi®) signals or Bluetooth® signals may also be provided in regions 22 and/or 24 (either as separate additional antennas or as parts of the first and second cellular telephone antennas). Antenna structures may also be provided in regions 22 and/or 24 to handle WiMax (IEEE 802.16) signals.

In regions 22 and 24, openings may be formed between conductive housing structures and printed circuit boards and other conductive electrical components that make up device 10. These openings may be filled with air, plastic, or other dielectrics. Conductive housing structures and other conductive structures may serve as a ground plane for the antennas in device 10. The openings in regions 22 and 24 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element such as an inverted-F antenna resonating element formed from part of conductive peripheral housing member 17 from the ground plane, may serve two or more of these functions (e.g., in antenna structures that are configured to operate in different configurations at different frequencies), or may otherwise serve as part of antenna structures formed in regions 22 and 24.

Antennas may be formed in regions 22 and 24 that are identical (i.e., antennas may be formed in regions 22 and 24 that each cover the same set of cellular telephone bands or other communications bands of interest). Due to layout constraints or other design constraints, it may not be desirable to use identical antennas. Rather, it may be desirable to implement the antennas in regions 22 and 24 using different designs. For example, the antennas in regions 22 and 24 may be implemented using different antennas types, may be implemented using designs that exhibit different gains, may be implemented so that one end of device 10 houses a fixed antenna while the opposing end of device 10 houses an adjustable antenna, and/or may be implemented using designs that cover different frequency ranges.

Device 10 may use any suitable number of antennas. For example, device 10 may have one antenna, two or more antennas, three or more antennas, four or more antennas, or five or more antennas. Device 10 may, for example, include at least a first antenna such as a cellular telephone antenna in region 22 and a second antenna such as a cellular telephone antenna in region 24. Additional antennas (e.g., local area network antennas, a satellite navigation antenna, etc.) may be formed in region 22 and/or region 24 or other suitable portions of device 10.

Figure 2:
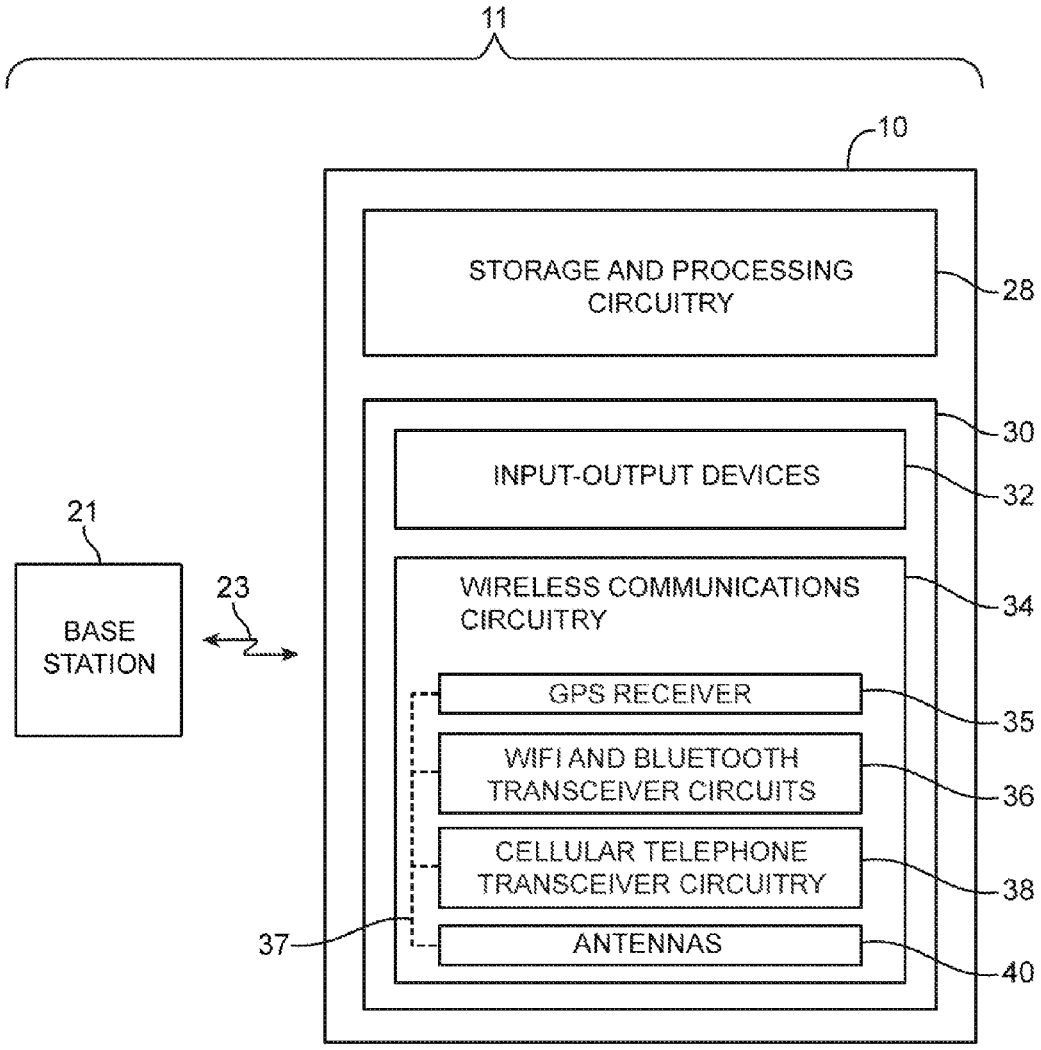
FIG. 2 is a schematic diagram of a system that includes an electronic device of the type that may be provided with adjustable antenna structures in accordance with an embodiment of the present invention.

A schematic diagram of a system in which electronic device 10 may operate is shown in FIG. 2. As shown in FIG. 2, system 11 may include wireless network equipment such as base station 21. Base stations such as base station 21 may be associated with a cellular telephone network or other wireless networking equipment. Device 10 may communicate with base station 21 over wireless link 23 (e.g., a cellular telephone link or other wireless communications link).

Device 10 may include control circuitry such as storage and processing circuitry 28. Storage and processing circuitry 28 may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in storage and processing circuitry 28 and other control circuits such as control circuits in wireless communications circuitry 34 may be used to control the operation of device 10. This processing circuitry may be based on one or more microprocessors, microcontrollers, digital signal processors, baseband processors, power management units, audio codec chips, application specific integrated circuits, etc.

Storage and processing circuitry 28 may be used to run software on device 10, such as internet browsing applications, voice-over-internet-protocol (VoIP) telephone call applications, email applications, media playback applications, operating system functions, etc. To support interactions with external equipment such as base station 21, storage and processing circuitry 28 may be used in implementing communications protocols. Communications protocols that may be implemented using storage and processing circuitry 28 include internet protocols, wireless local area network protocols (e.g., IEEE 802.11 protocols—sometimes referred to as WiFi®), protocols for other short-range wireless communications links such as the Bluetooth® protocol, IEEE 802.16 (WiMax) protocols, cellular telephone protocols such as the Long Term Evolution (LTE) protocol, Global System for Mobile Communications (GSM) protocol, Code Division Multiple Access (CDMA) protocol, and Universal Mobile Telecommunications System (UMTS) protocol, etc.

Circuitry 28 may be configured to implement control algorithms for device 10. The control algorithms may be used to control radio-frequency switching circuitry, transceiver circuitry, and other device resources. The control algorithms may also be used to activate and deactivate transmitters and receivers, to tune transmitters and receivers to desired frequencies, to compare measured device operating parameters to predetermined criteria, to adjust switching circuitry in antenna structures, etc.

In some scenarios, circuitry 28 may be used in gathering sensor signals and signals that reflect the quality of received signals (e.g., received pilot signals, received paging signals, received voice call traffic, received control channel signals, received data traffic, etc.). Examples of signal quality measurements that may be made in device 10 include bit error rate measurements, signal-to-noise ratio measurements, measurements on the amount of power associated with incoming wireless signals, channel quality measurements based on received signal strength indicator (RSSI) information (RSSI measurements), channel quality measurements based on received signal code power (RSCP) information (RSCP measurements), reference symbol received power (RSRP measurements), channel quality measurements based on signal-to-interference ratio (SINR) and signal-to-noise ratio (SNR) information (SINR and SNR measurements), channel quality measurements based on signal quality data such as Ec/lo or Ec/No data (Ec/lo and Ec/No measurements), etc. This information and other data may be used in controlling how the wireless circuitry of device 10 is configured and may be used in otherwise controlling and configuring device 10. For example, signal quality information, information received from base station 21, and other information may be used in determining which communications bands are to be used in handling wireless signals for device 10. As device 10 communicates at different frequencies, the antenna structures in device 10 may be used to cover appropriate communications bands. For example, the resonant circuits in the antenna structures may exhibit different impedances at different frequencies so that the configuration of the antenna structures in device 10 changes as a function of frequency and/or the control circuitry in device 10 may generate control signals to adjust one or more switches and thereby dynamically configure the antenna structures to cover desired communications bands.

Input-output circuitry 30 may be used to allow data to be supplied to device 10 and to allow data to be provided from device 10 to external devices. Input-output circuitry 30 may include input-output devices 32. Input-output devices 32 may include touch screens, buttons, joysticks, click wheels, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 32 and may receive status information and other output from device 10 using the output resources of input-output devices 32.

Wireless communications circuitry 34 may include radio-frequency (RF) transceiver circuitry formed from one or more integrated circuits, power amplifier circuitry, low-noise input amplifiers, passive RF components, one or more antennas, and other circuitry for handling RF wireless signals.

Wireless communications circuitry 34 may include satellite navigation system receiver circuitry such as Global Positioning System (GPS) receiver circuitry 35 (e.g., for receiving satellite navigation system signals at 1575 MHz). Transceiver circuitry 36 may handle 2.4 GHz and 5 GHz bands for WiFi® (IEEE 802.11) communications and may handle the 2.4 GHz Bluetooth® communications band. Circuitry 34 may use cellular telephone transceiver circuitry 38 for handling wireless communications in cellular telephone bands such as bands at 700 MHz, 850 MHz, 900 MHz, 1800 MHz, 1900 MHz, 2100 MHz, 2300 MHz, and other cellular telephone bands of interest. Wireless communications circuitry 34 can include circuitry for other short-range and long-range wireless links if desired (e.g., WiMax circuitry, etc.). Wireless communications circuitry 34 may, for example, include, wireless circuitry for receiving radio and television signals, paging signals, etc. In WiFi® and Bluetooth® links and other short-range wireless links, wireless signals are typically used to convey data over tens or hundreds of feet. In cellular telephone links and other long-range links, wireless signals are typically used to convey data over thousands of feet or miles.

Wireless communications circuitry 34 may include antennas 40. Antennas 40 may be coupled to transceiver circuitry such as receiver 35, transceiver 36, and transceiver 38 using transmission lines 37. Transmission lines 37 may include coaxial cables, microstrip transmission lines, stripline transmission lines, and/or other transmission line structures. Matching circuits may be interposed within the transmission lines (e.g., to match transmission line impedance to transceiver circuitry impedance and/or antenna impedance). Antennas 40 may be formed using any suitable types of antenna. For example, antennas 40 may include antennas with resonating elements that are formed from loop antenna structures, patch antenna structures, inverted-F antenna structures, closed and open slot antenna structures, planar inverted-F antenna structures, helical antenna structures, strip antennas, monopoles, dipoles, hybrids of these designs, etc. Different types of antennas may be used for different bands and combinations of bands. For example, one type of antenna may be used in forming a local wireless link antenna (e.g., for handling WiFi® traffic or other wireless local area network traffic) and antennas of one or more other types may be used in forming a remote wireless link antenna (e.g., for handling cellular network traffic such as voice calls and data sessions). As described in connection with FIG. 1, there may be one cellular telephone antenna in region 24 of device 10 and another cellular telephone antenna in region 22 of device 10. These antennas may be fixed or may be adjustable (e.g., using resonant circuits that change impedance as a function of frequency and/or using one or more switches that can be opened and closed to adjust antenna performance).

Figure 3:
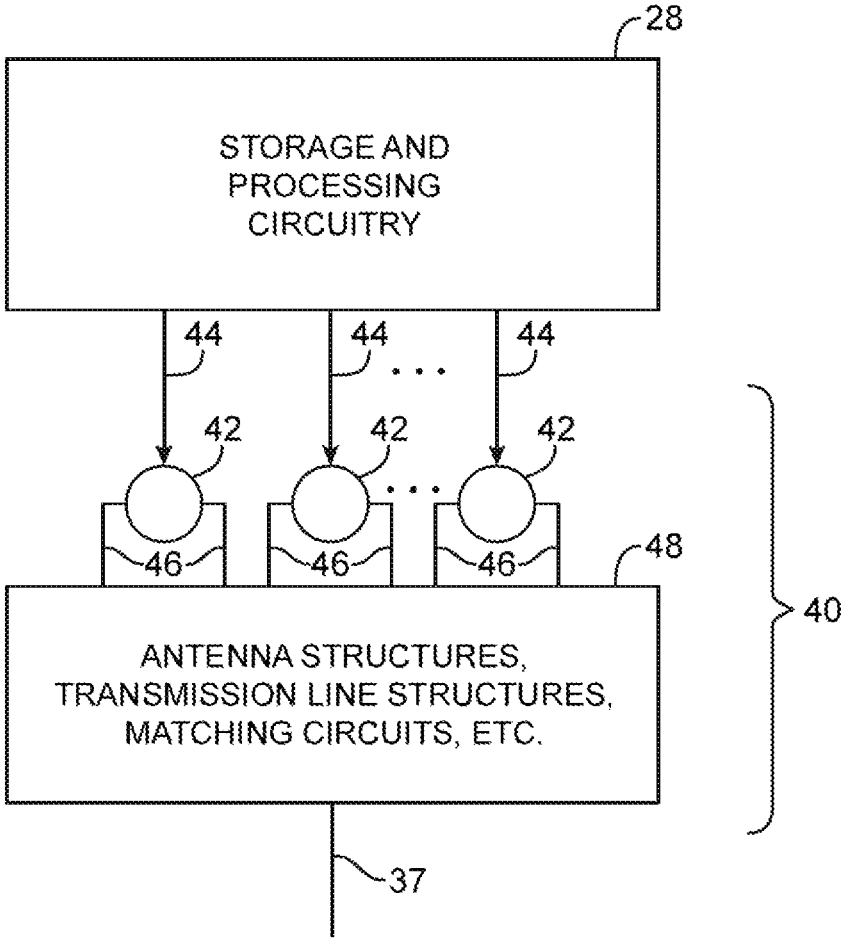
FIG. 3 is a circuit diagram of storage and processing circuitry in an electronic device that is coupled to an adjustable antenna in accordance with an embodiment of the present invention.

As shown in FIG. 3, antenna structures 40 (e.g., a cellular telephone antenna or other suitable antenna structures in region 22 and/or region 24) may include one or more electrical components 42. Electrical components 42 may be passive circuits that change their impedance at high and low frequencies such as resonant circuits and/or dynamically adjustable components (switches). Components 42 may be coupled between respective portions of conductive antenna structures 48 using paths such as paths 46. Antenna structures 48 may include patterned traces of metal on substrates such as plastic carriers, flexible printed circuit substrates, rigid printed circuit substrates, patterned metal foil, conductive device structures such as conductive housing structures (e.g., all or part of conductive peripheral housing member 17 of FIG. 1), wires, transmission line structures, or other conductive structures.

Control signals may optionally be provided to components 42 from control circuitry such as storage and processing circuitry 28 using paths 44. Paths 44 and 46 may be formed from patterned traces on substrates such as plastic carriers, flexible printed circuit substrates, rigid printed circuit substrates, patterned metal foil, conductive device structures such as conductive housing structures (e.g., all or part of conductive peripheral housing member 17 of FIG. 1), wires, transmission line structures, or other conductive structures. Paths 44 and 46 and/or components 42 may sometimes be referred to as antenna structures and may be used with antenna structures 48 to form antenna structures 40. Antenna structures 40 (sometimes referred to as antenna 40 or adjustable antenna 40) may be coupled to a radio-frequency transceiver circuit in wireless circuitry 34 using transmission line 37. Transmission line 37 may be formed from transmission line structures such as coaxial cables, microstrip transmission lines, stripline transmission lines, or other suitable transmission line. If desired, filters, impedance matching circuitry, switches, and other circuitry may be interposed in the path between the radio-frequency transceiver and antenna 40. There may be one or more antennas such as antenna 40 in device 10. For example, there may be a first antenna such as antenna 40 of FIG. 3 in region 22 of housing 12 and a second antenna such as antenna 40 of FIG. 3 or a fixed antenna in region 24 of housing (as an example).

One or more electrical components such as components 42 may be used in configuring antenna structures 40 to cover operating frequencies of interest. Components 42 may be implemented using passive circuits (i.e., resonant circuits) and/or switches. When implemented using switches, control circuitry in device 10 such as storage and processing circuitry 28 (e.g., a baseband processor or other processor) may be used in issuing control commands for the switches on paths 44. The control circuitry may, for example, issue a first set of one or more control signals to open and/or close one or more switches 42 for a first mode of operation, may issue a second set of one or more control signals to open and/or close one or more switches 42 for a second mode of operation, and may issue additional sets of control signals to place switches 42 in desired states for supporting optional additional mode of operation. When configured for the first mode of operation, antenna structures 40 may cover a first set of frequencies (e.g., a first set of cellular telephone communications bands or other desired frequency range(s)). When configured for the second mode of operation, antenna structures 40 may cover a second set of frequencies. Additional sets of operating frequencies (i.e., one or more communications bands) may be covered by configuring switches 42 for its optional additional modes of operation.

When implementing components 42 using passive circuitry (i.e., resonant circuits that do not include switches), components 42 may reconfigure antenna structures 40 by virtue of their frequency-dependent impedance. Combinations of components 42 based on switches and based on passive (non-switching) circuits may be provided to configure antenna 40 across frequencies if desired. Because antenna 40 can change its configuration during operation, a potentially wider range of operating frequencies can be covered than would be possible using a fixed (non-switching and frequency-independent) antenna arrangement. This may allow antenna 40 to be implemented in a relatively compact region of device 10 and may allow antenna 40 to be implemented in the vicinity of conductive device structures (e.g., adjacent to peripheral conductive housing member 17, ground plane structures in device 10, or other conductive structures). Antenna 40 may also be formed using portions of member 17 or other conductive device structures (e.g., ground plane structures, electrical components, etc.).

Figure 4:
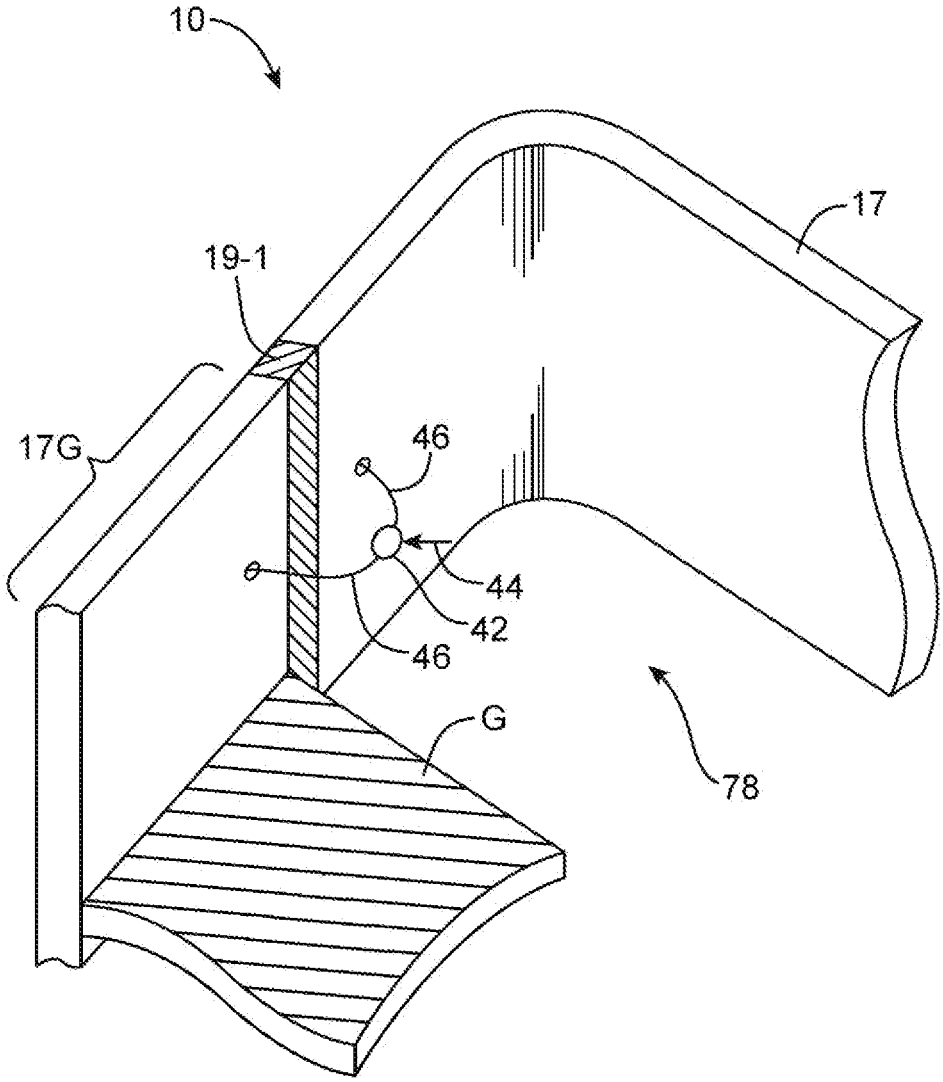
FIG. 4 is a perspective view of an interior portion of an electronic device showing how an electrical component such as a resonant circuit or a switch may be used to bridge a dielectric-filled gap in a peripheral conductive housing member so as to interconnect conductive antenna structures in accordance with an embodiment of the present invention.

FIG. 4 is a perspective view of a portion of the interior of an illustrative device such as device 10 of FIG. 1. As shown in FIG. 4, peripheral conductive housing member 17 may be separated from ground structures G by dielectric-filled region 78. Region 78 may include air, plastic, glass, ceramic, or other dielectric. Although the outline of region 78 is shown as being formed from the inner shape of member 17 and the opposing edge of ground plane G in the example of FIG. 4, any suitable conductive structures may be used in defining the shape of region 78. For example, conductive structures such parts of electrical components that are connected to member 17 and/or ground plane G and/or that are mounted in the device housing adjacent to member 17 and/or ground plane G may effectively change the size and shape of the conductive material that surrounds region 78 and may therefore serve to define the inner perimeter of region 78.

The conductive structures of ground plane G may be formed from sheet metal structures (e.g., a single-part of multi-part planar midplate member with optional stamped features that is welded between left and right portions of member 17), from printed circuit board traces, from housing frame members, from conductive display structures, from conductive structures associated with peripheral conductive housing member 17 such as portion 17G, from conductive materials in electronic components that are coupled to ground plane G, or other conductive structures.

Dielectric gaps between respective conductive antenna structures such as gap 19-1 in conductive member 17 of FIG. 4 may be filled with plastic or other dielectric materials. Component 42 may be coupled between respective portions of member 17 (or other conductive antenna structures) to bridge gap 19-1 using paths 46. Component 42 may be coupled within the structures of antenna 40 using paths 46 that include welds, springs, screws, solder, conductive lines, or other suitable attachment structures. Path 44 may be used to apply control signals to component 42 (e.g., when component 42 is implemented using a switch). If desired, path 44 may be omitted (e.g., when component 42 is implemented using a resonant circuit).

Dielectric-filled region (antenna opening) 78 may be filled with plastic (e.g., plastic that is insert molded over patterned sheet metal structures in ground plane G), air, glass, ceramic, or other dielectric materials. There may be one or more components such as component 42 of FIG. 4 in antenna 40 (see, e.g., FIG. 3).

Figure 5:
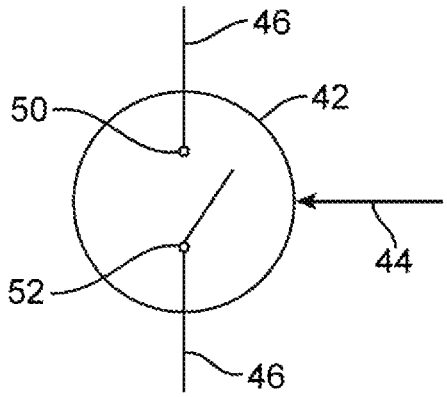
FIG. 5 is a diagram of an illustrative switch of the type that may be opened and closed by control circuitry to adjust an adjustable antenna so that the antenna operates in different antenna modes in different respective wireless communications bands in accordance with an embodiment of the present invention.

A circuit diagram of an illustrative switch-based configuration for component 42 is shown in FIG. 5. As shown in FIG. 5, component (switch) 42 may be responsive to control signals supplied on control input 44. Switch 42 may be implemented as two-terminal or three-terminal devices such as diode-based switches, transistor switches, microelectromechanical systems (MEMs) switches, etc. In a two-terminal arrangement, control path 44 may be omitted. In a three-terminal configuration, path 44 may be used to supply signals such as digital (high/low) control signals to switch 42. Switch 42 of FIG. 5 may be placed in an open configuration in which terminals 50 and 52 are isolated from one another or a closed position in which terminals 50 and 52 are electrically connected to one another (i.e., a position in which terminals 50 and 52 are shorted together).

Figure 6:
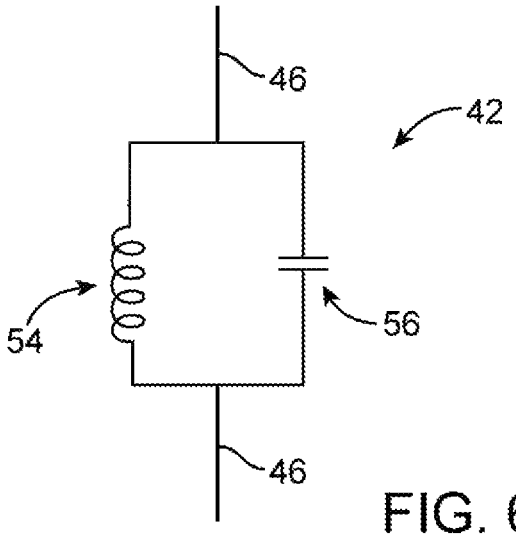
FIG. 6 is a circuit diagram of an illustrative resonant circuit of the type that may exhibit different impedances at different operating frequencies when used in an adjustable antenna so that the so that the antenna operates in different antenna modes in different respective wireless communications bands in accordance with an embodiment of the present invention.

As shown in FIG. 6, component 42 may be implemented using a resonant circuit. The resonant circuit may include electrical components such as resistors, inductors, and capacitors. In the illustrative arrangement of FIG. 6, component 42 has parallel-connected components such as inductor 54 and capacitor 56. This is merely illustrative. Resonant circuits for forming components 42 may be formed using one or more series-connected resistors, capacitors, and/or inductors, one or more parallel-connected resistors, capacitors, or inductors, or any other suitable network of electrical components that exhibit impedance values that vary as a function of frequency. The components of resonant circuit 42 may, as an example, be selected so that resonant circuit 42 exhibits an impedance in one operating band (e.g., a low-frequency communications band) that is at least ten times its impedance in another operating band (e.g., a high-frequency communications band).

Figure 7:
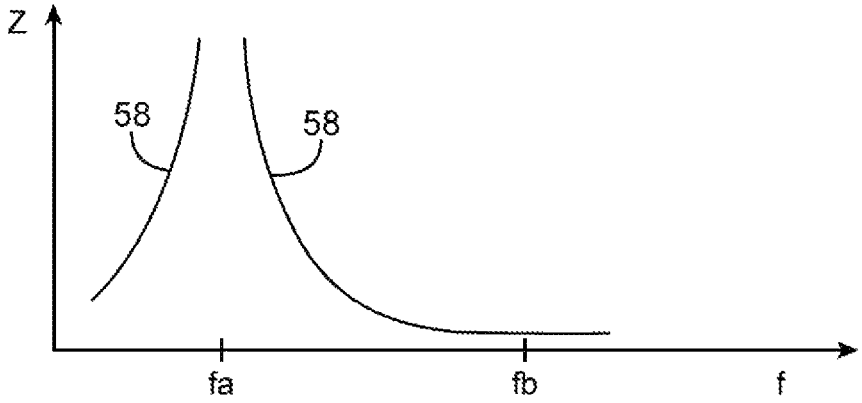
FIG. 7 is a graph showing how the impedance of a resonant circuit of the type shown in FIG. 6 may vary as a function of frequency so that the circuit exhibits different impedances at different operating frequencies when used in an adjustable antenna in accordance with an embodiment of the present invention.

A graph in which the impedance Z for a resonant circuit such as resonant circuit 42 of FIG. 6 has been plotted as a function of operating frequency f is shown in FIG. 7. As shown by line 58 of FIG. 7, the impedance of the resonant circuit may be relatively low at higher frequencies such as frequency fb and may be relatively high at lower frequencies such as frequency fa that are at or near the resonance frequency for the circuit (in this example). Due to the frequency-dependent behavior of the impedance Z of the resonant circuit, resonant-circuit-based components such as component 42 of FIG. 6 may be used to form short circuits (or nearly short circuits) at some frequencies of antenna operation (e.g., one or more bands of frequencies in the vicinity of frequency fb) and may be used to form open circuits (or nearly open circuits) at other frequencies of antenna operation (e.g., one or more bands of frequencies in the vicinity of frequency fa). The open/closed behavior of resonant-circuit-based components such as component 42 may be used in implementing frequency-dependent antenna configuration changes in antenna 40 instead of or in addition to using the open/close behavior of switched based components such as component 42 of FIG. 5 in antenna 40.

Antenna 40 may be based on antenna structures of any suitable type such as structures for implementing a patch antenna, an inverted-F antenna, a planar inverted-F antenna, an open or closed slot antenna, a monopole antenna, a dipole antennas, a coil antenna, an L-shaped antenna, or other suitable antenna.

Figure 8:
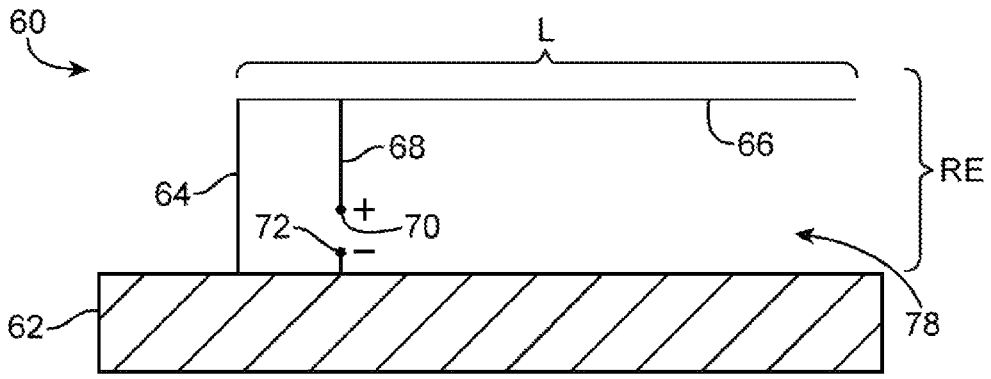
FIG. 8 is a diagram of an illustrative inverted-F antenna of the type that may be used in forming part of an adjustable antenna in accordance with an embodiment of the present invention.

An illustrative inverted-F antenna is shown in FIG. 8. As shown in FIG. 8, inverted-F antenna 60 may include an antenna resonating element such as antenna resonating element RE. Antenna resonating element RE may have a main conductive branch such as branch 66 that is separated from a ground plane element such as ground plane G by dielectric-filled opening 78. The conductive segment that forms branch 66 may be electrically coupled to ground 62 using short circuit branch 64 of resonating element RE. Antenna 60 may be fed using an antenna feed in antenna feed branch 68. The antenna feed may include antenna feed terminals such as positive antenna feed terminal 70 and ground antenna feed terminal 72.

Figure 9:
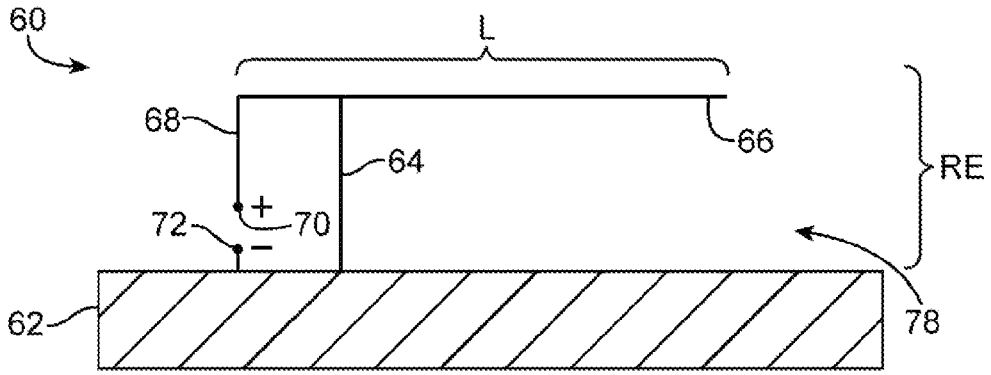
FIG. 9 is a diagram of another illustrative inverted-F antenna of the type that may be used in forming part of an adjustable antenna in accordance with an embodiment of the present invention.

Another illustrative configuration that may be used for inverted-F antenna 60 is shown in FIG. 9. In the configuration of FIG. 9, the positions of short circuit branch 64 and feed branch 68 have been reversed relative to those of the inverted-F antenna configuration shown in FIG. 8.

Antenna structures that form one or more inverted-F antenna arrangements such as the antenna structures of FIGS. 8 and 9 may be used in forming antenna 40.

If desired, antenna 40 may be formed using a design that incorporates antenna structures associated with multiple antennas. Antenna 40 may, for example, be formed from a first antenna of a first design and a second antenna of a second design that are coupled together using one or more components 42 (e.g., one or more switches and/or resonant circuits). The first and second antenna designs may be selected from antenna designs such as patch antenna designs, monopole designs, dipole designs, inverted-F antenna designs, planar inverted-F antenna designs, open slot designs, closed slot antenna designs, loop antenna designs, or other suitable antenna designs.

As an illustrative example, antenna 40 may be formed from at least a first antenna such as an inverted-F antenna and at least a second antenna such as a slot antenna.

Figure 10:
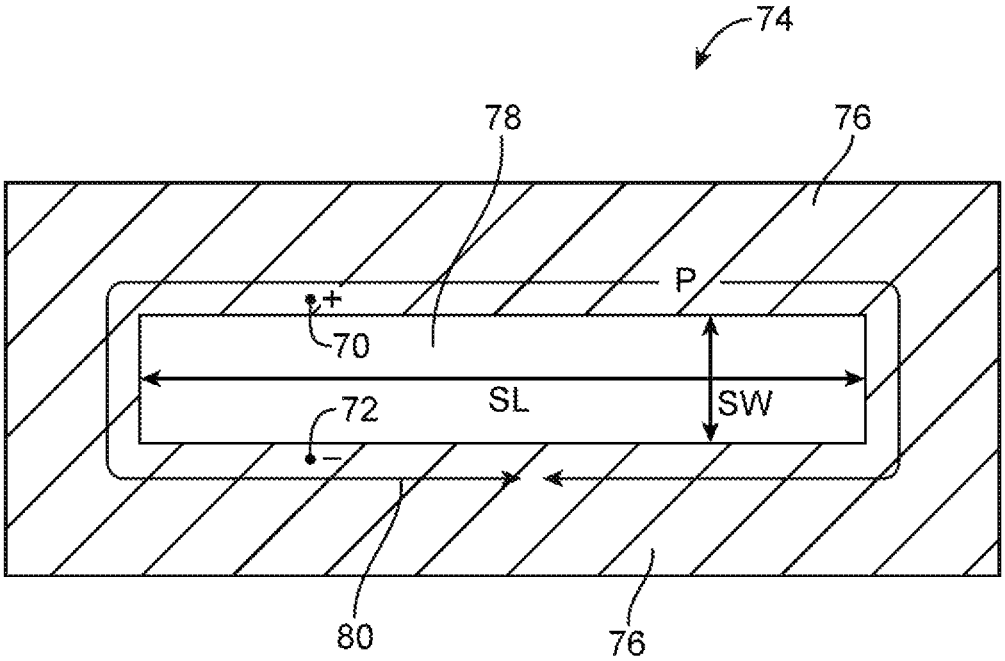
FIG. 10 is a diagram of an illustrative slot antenna of the type that may be used in forming part of an adjustable antenna in accordance with an embodiment of the present invention.

An illustrative slot antenna is shown in FIG. 10. As shown in FIG. 10, slot antenna 74 may include a conductive structure such as structure 76 that has been provided with a dielectric opening such as dielectric opening 78. Openings such as opening 78 of FIG. 10 are sometimes referred to as slots. In the configuration of FIG. 10, opening 78 is a closed slot, because portions of conductor 76 completely surround and enclose opening 78. Open slot antennas may also be formed in conductive materials such as conductor 76 (e.g., by forming an opening in the right-hand or left-hand end of conductor 76 so that opening 78 protrudes through conductor 76).

An antenna feed for slot antenna 74 may be formed using positive antenna feed terminal 70 and ground antenna feed terminal 72.

The frequency response of an antenna is related to the size and shapes of the conductive structures in the antenna. Inverted-F antennas of the type shown in FIGS. 8 and 9 tend to exhibit frequency peaks (peak responses) when length L of main resonating element branch 66 of antenna resonating element RE is equal to a quarter of a wavelength. Slot antennas of the type shown in FIG. 10 tend to exhibit response peaks when slot perimeter P is equal to a wavelength.

As a result of this type of behavior, slot antennas tend to be more compact than inverted-F antennas for a given operating frequency. For a typical slot where slot length SL>> slot width SW, the length of a slot antenna will tend to be about half of the length of an inverted-F antenna that is configured to handle signals at the same frequency. When the size of inverted-F antenna length L and slot length SL are equal, the slot antenna will therefore be able to handle signals at approximately twice the frequency of the inverted-F antenna.

These attributes of inverted-F and slot antennas can be exploited to form a multi-band antenna such as an antenna having both inverted-F and slot antenna portions in which the inverted-F antenna portion of the antenna is used in transmitting and receiving low-band signals at a given frequency and in which the slot antenna portion of the antenna is used in transmitting and receiving high-band signals at approximately twice the given frequency (or other appropriate higher frequency). Components 42 such as switches and/or resonant circuits can be used to couple the conductive antenna structures that form the inverted-F and slot antenna portions of the multi-band antenna. The number of components 42 that are included in the antenna may be selected to ensure that the antenna can be operated in all desired frequency bands. If, for example, the antenna is to be operated in a single low band and a single high band, a single component 42 may suffice to allow the antenna to transition between a low band (inverted-F) operating regime and a high band (slot) operating regime. More components 42 may be used in scenarios in which the antenna is used to cover additional communications bands of interest (e.g., multiple inverted-F modes and/or multiple slot antenna modes).

Figure 11:
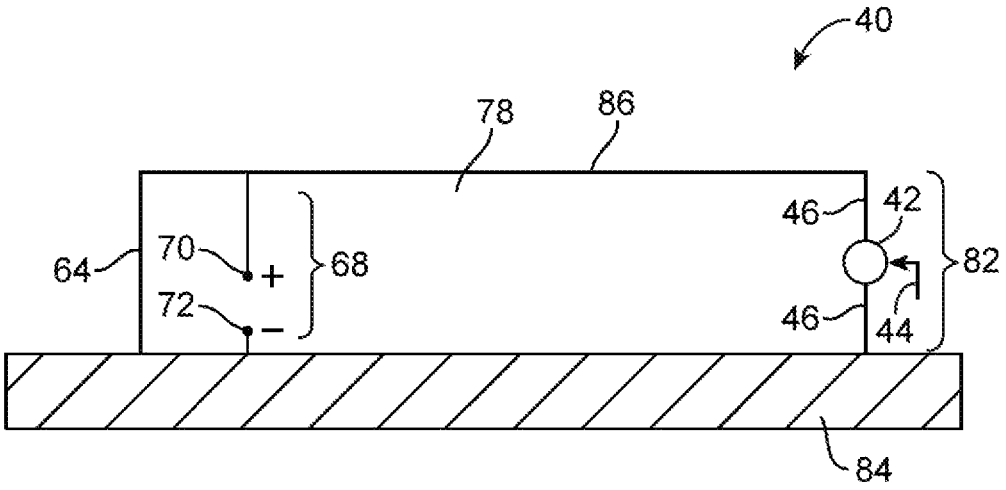
FIG. 11 is a diagram of an illustrative adjustable antenna having conductive antenna structures and an electronic component with a frequency-dependent impedance such as an actively controlled switch or a passive resonant circuit that allows the adjustable antenna to operate as an inverted-F antenna at low frequencies and as a slot antenna at high frequencies in accordance with an embodiment of the present invention.

An illustrative configuration for antenna 40 that includes inverted-F (e.g., planar inverted-F or non-planar inverted-F) and slot antenna portions is shown in FIG. 11. Antenna 40 may include a conductive structures such as structure 84 (e.g., ground plane structures) and a main branch such as branch 86. Branch 86 may run parallel to conductive structure 84 for at least some of its length and may be separated from conductive structure 84 by dielectric-filled region 78. Short circuit branch (segment) 64 of antenna 40 may be electrically connected between branch (segment) 86 and structure (segment) 84. Feed branch (segment) 68 may span opening 78. Antenna segment 82 may be formed at the opposing end of opening 78 from short circuit path 64. Component 42 may be implemented using a resonant circuit that exhibits low impedance at high frequencies and high impedance at low frequencies or using a switch such as a switch that receives control signals from device control circuitry via path 44.

The conductive structures (paths) in antenna 40 such as segments 64, 68, 86, 84, and 82 may be used in forming both inverted-F and slot antennas. The inverted-F characteristic of antenna 40 can be exploited at low-band operating frequencies (i.e., frequencies where the length of segment 86 is about a quarter of a wavelength). In this operating frequency range, the control circuitry of device 10 may actively open switch 42 to form an open circuit at the right-hand end of opening 78 (placing antenna 40 of FIG. 11 in an inverted-F operating mode) or the high-impedance characteristics of a resonant-circuit component 42 may form the open circuit. The slot antenna characteristic can be exploited at high-band operating frequencies (i.e., frequencies where the periphery of opening (slot) 78 is about equal to a wavelength. In this operating frequency range, the control circuitry of device 10 may be actively closed, so that paths 46 and component 42 convert segment 82 into a short circuit that electrically connects path 86 and path 84 or a resonant-circuit version of component 42 may form a low-impedance (short circuit) element that couples paths 46 and causes segment 82 to electrically connect path 86 to path 84.

Figure 12:
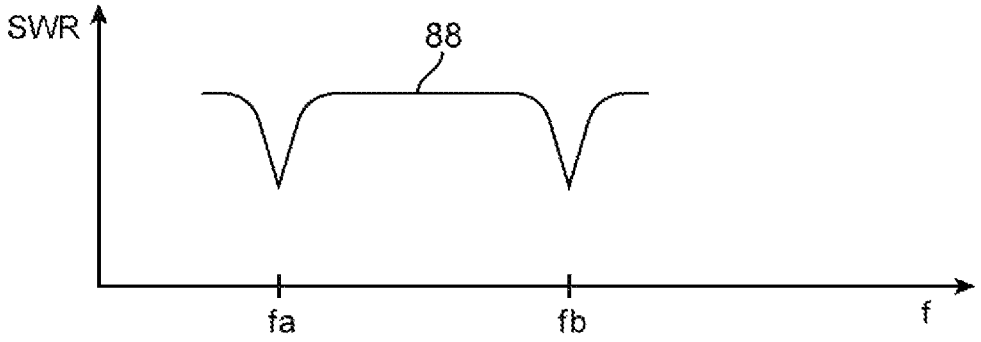
FIG. 12 is a graph showing how an adjustable antenna of the type shown in FIG. 11 may be configured to operate in a first communications band centered at a first (lower) frequency and may be configured to operate in a second communications band centered at a second (higher) operating frequency.

FIG. 12 is a graph in which antenna performance (standing wave ratio SWR) for an antenna such as antenna 40 of FIG. 11 has been plotted as a function of operating frequency f. As shown in FIG. 12, antenna 40 may exhibit a low-band frequency response in a communications band that is centered at frequency fa and may exhibit a high-frequency frequency response in a communications band that is centered at frequency fb. The coverage provided at frequency fa may arise due to the inverted-F antenna characteristic of antenna 40, whereas the coverage provided at frequency fb may be supported using the slot antenna characteristic of antenna 40. When component 42 of FIG. 11 is implemented using a switch, the control circuitry of device 10 may close the switch whenever using device 10 to handle wireless signals in the fb communications band and may open the switch whenever using device 10 to handle wireless signals in the fa communications band. When component 42 of FIG. 11 is implemented using a resonant circuit, the values of the circuit components in the resonant circuit may be selected to ensure that the resonant circuit exhibits a high impedance at frequencies in the band at frequency fa and a low frequency in the frequencies associated with the communications band centered at frequency fb.

Figure 13:
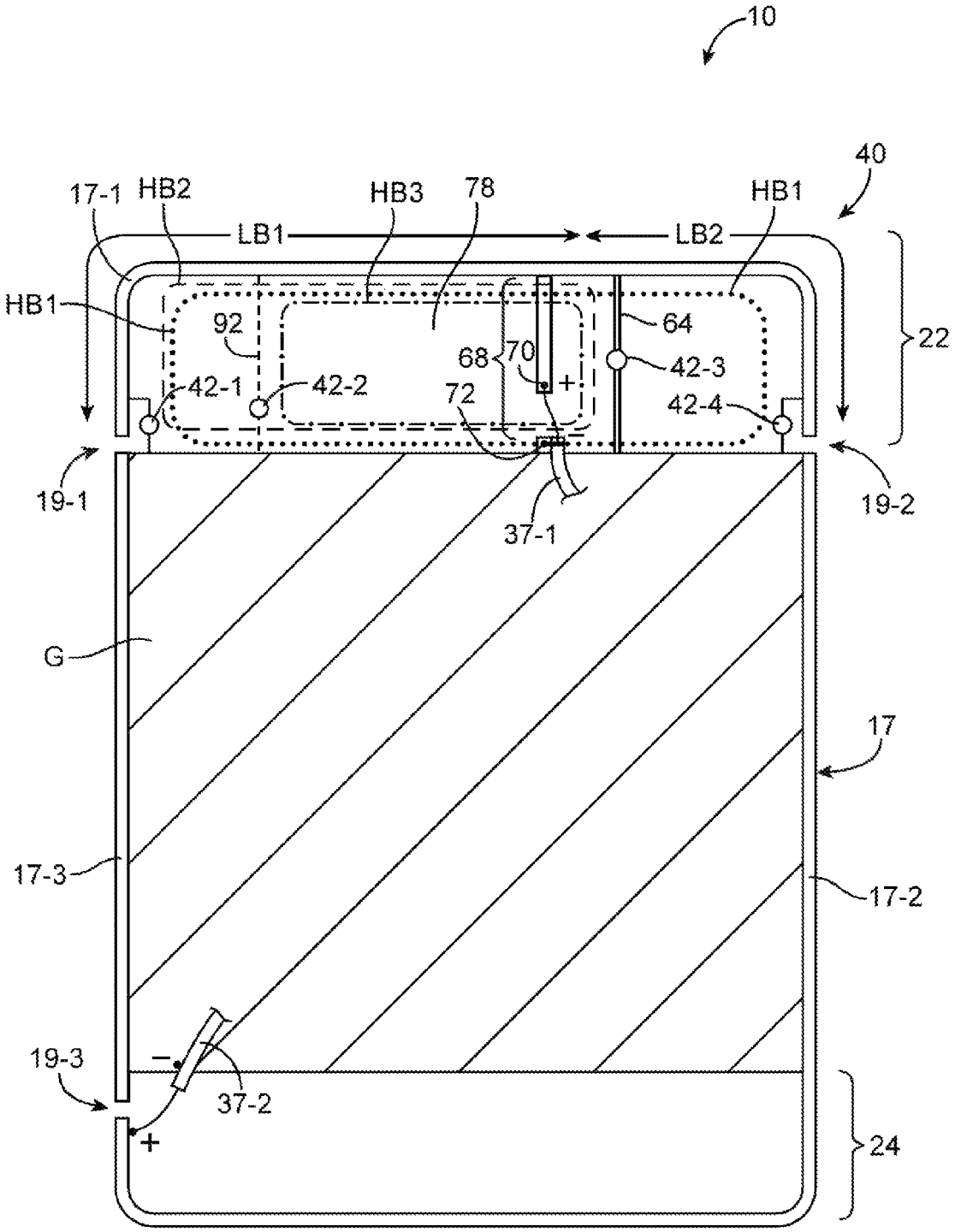
FIG. 13 is a top view of an illustrative electronic device that contains antennas such as an adjustable antenna having inverted-F and slot antenna operating modes in accordance with an embodiment of the present invention.

As shown in FIG. 13, device 10 may have multiple antennas including a first antenna such as a lower antenna in region 24 and an upper antenna in region 22 (as an example). The antenna in region 24 may be a loop antenna that is formed from portions of ground plane G and peripheral conductive housing member 17 such as the lower portions of housing member segment 17-2. The antenna in region 24 may be fed using transmission line 37-2. Antenna 40 in region 22 may include conductive structures such as portions of peripheral conductive housing member segment 17-1, conductive path 68, conductive path 64, and optional conductive path 92. Conductive path 68 may form an antenna feed branch for antenna 40. Transmission line 37-1 may have a positive conductor coupled to positive antenna feed terminal 70 and a ground conductor coupled to antenna ground terminal 72.

Antenna 40 may include conductive structures that serve as one or more inverted-F antennas. For example, portion LB1 of peripheral conductive member 17-1 may serve as the main antenna resonating element branch of a first inverted-F antenna, feed path 68 may serve as the feed branch of the first inverted-F antenna, and path 64 may serve as a short circuit branch for the first inverted-F antenna. Portion LB2 of peripheral conductive member 17-1 may serve as the main antenna resonating element branch of a second inverted-F antenna, feed path 68 may serve as the feed branch of the second inverted-F antenna, and path 64 may serve as a short circuit branch for the second inverted-F antenna. In configurations in which branch LB1 is longer than branch LB2, the first inverted-F antenna may resonate in a first communications band (e.g. a first low band) and the second inverted-F antenna may resonating in a second communications band (e.g., a second low band). The second communications band may cover frequencies that are higher than the first communications band.

The structures of antenna 40 may include components 42 such as resonant circuits that exhibit a frequency-dependent impedance and/or components 42 such as switches that are controlled by application of control signals from the control circuitry within device 10. The states of components 42 may be used in configuring the structures of antenna 40 to operate as different types of antennas at different operating modes. For example, in a first range of frequencies (i.e., a lower frequency range), one or more of components 42 may form open circuits (i.e., because the impedance of one or more resonant-circuit components is high and/or one or more switch-type components have been placed in an open state). In a second range of frequencies (i.e., a higher frequency range), one or more of components 42 may form closed circuits (i.e., because the impedance of one or more resonant-circuit components is low and/or because one or more switch-type components have been placed in a closed state).

Antennas such as antenna 40 of FIG. 13 may have one, two, three, four, or more than four components 42 and may exhibit the characteristics of one or more inverted-F antennas and one or more slot antennas.

Consider, as an example, a configuration for antenna 40 in which components 42-1, 42-2, and 42-4 are open and component 42-3 is closed (or antenna 40 is using an arrangement in which short circuit path 64 is devoid of interposed components 42). In this configuration, gaps 19-1 and 19-2 in peripheral conductive housing member form open circuits in peripheral conductive housing member 17 and electrically isolate peripheral conductive housing member segment 17-1 from segments 17-2 and 17-3. The upper portions of ground plane structures G are separated from member 17-1 by dielectric-filled opening 78. Arm LB1 therefore forms the main branch of a first inverted-F antenna and arm LB2 forms the main branch of a second inverted-F antenna in antenna 40. The first and second inverted-F portions of antenna 40 may each contribute to antenna coverage in a different communications band.

Antenna 40 may operate in slot antenna modes of operation at different operating frequencies. Consider, as an example, a scenario in which component 42-1 is closed (exhibits a low impedance) and bridges gap 19-1, component 42-4 is closed (exhibits a low impedance) and bridges gap 19-2, and component 42-3 is open (exhibits a high impedance). Optional path 92 may, if desired, be omitted or component 42-2 can be placed in an open state (or operated at a frequency at which component 42-2 exhibits a high impedance). In this mode of operation, a slot antenna with an inner periphery HB1 may be formed.

In a second slot antenna mode of operation, components 42-1 and 42-3 may be closed (low impedance state). Component 42-2 may be open or operating in a high-impedance state due to the operating frequency of the antenna. (Path 92 may also be omitted from antenna 40, if desired.) In this second slot mode of operation, antenna 40 functions as a slot antenna with inner perimeter HB2. The size of perimeter HB2 is smaller than the size of perimeter HB1, so antenna 40 will resonate in a higher frequency band in the second slot mode of operation than in the first slot mode of operation.

If it is desired to operate antenna 40 in yet a higher frequency band, switch 42-2 may be closed (actively or passively by virtue of operating antenna 40 at a higher frequency), thereby forming a third slot having inner perimeter HB3. The size of inner perimeter HB3 is smaller than that of perimeter HB2, causing the third slot to resonate at a higher frequency band than the second slot.

If desired, an antenna of the type shown in FIG. 13 may exhibit more modes of operation (e.g., by adding additional conductive paths with interposed components 42 that overlap opening 78 or by otherwise connecting conductive structures in antenna 40 together using one or more additional components 42). An antenna of the general type shown in FIG. 13 may also be simplified by removing one or more of its conductive paths. For example, conductive path 92 may be omitted. Optional component 42-3 in path 64 may be omitted, etc. The number of bands of coverage and the number of components 42 that are used in device 10 can be selected to cover desired communications bands of interest while ensuring that the design of device 10 does not become overly costly or complex.

Figure 14:
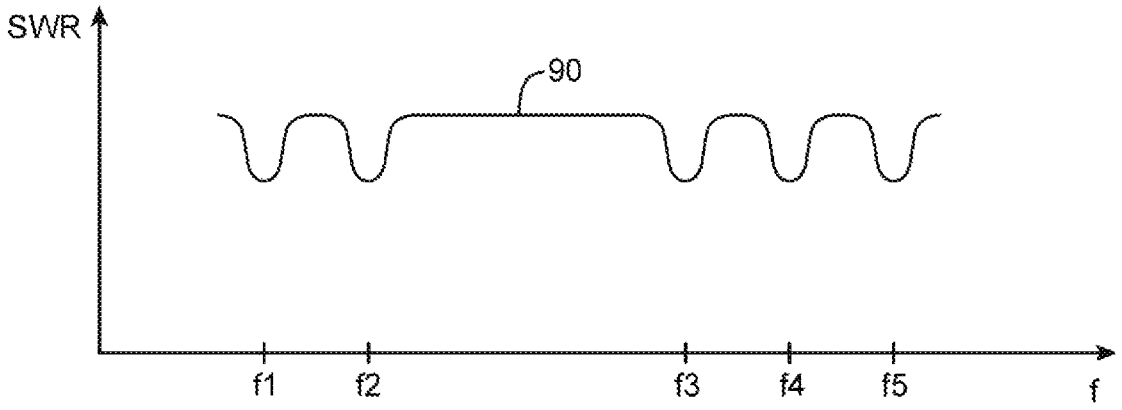
FIG. 14 is a graph showing illustrative communications bands that may be covered using an adjustable antenna of the type shown in FIG. 13 in accordance with an embodiment of the present invention.

FIG. 14 is a graph in which antenna performance (standing wave ratio or SWR) has been plotted as a function of operating frequency f (curve 90). In the example of FIG. 14, an antenna such as antenna 40 of FIG. 13 is exhibiting resonant peaks in five frequency bands (i.e., communications bands centered at f1, f2, f3, f4, and f5). The communications band at frequency f1 may, for example, be a first low band and may correspond to operation of antenna 40 in a mode in which a first inverted-F antenna formed by main antenna branch LB1 is active. The communications band at frequency f2 may, for example, be a second low band and may correspond to operation of antenna 40 in a mode in which a second inverted-F antenna formed by main antenna branch LB2 is active. In covering the communications band centered on frequency f3, antenna 40 may be operating in a mode in which a first slot antenna associated with slot perimeter HB1 is active. In covering the communications band centered on frequency f2, antenna 40 may be operating in a mode in which a second slot antenna associated with slot perimeter HB2 is active. The communications band associated with frequency f3 may be covered when antenna 40 operates in a mode in which a third slot antenna associated with slot perimeter HB3 is active.

This example, in which two inverted-F antenna operating modes and three slot antenna modes are supported by the conductive structures and components 42 of antenna 40 is merely illustrative. Fewer antenna modes or more antenna modes may be supported in antenna 40 if desired. Moreover, the frequencies of coverage may be adjusted by selecting appropriate lengths for the perimeter and main branches of the antenna slots and antenna resonating elements of antenna 40. Passive components such as resonating element components may be used in forming low-impedance and high-impedance paths at differing operating frequencies and/or switch-based components may be actively open and closed as appropriate by control circuitry in device 10 (i.e., to actively place antenna 40 in desired antenna modes depending on which frequency ranges are to be covered during operation of device).

The foregoing is merely illustrative of the principles of this invention and various modifications can be made by those skilled in the art without departing from the scope and spirit of the invention.

What is claimed is:

1. Antenna structures in an electronic device having four edges, a width that is shorter than the length, and a height that is shorter than the width, comprising:

conductive antenna structures that include a ground plane and a resonating element structure, the resonating element structure being formed from a portion of a peripheral conductive electronic device housing structure that extends across the height of the electronic device along each of the four edges, the portion of the peripheral conductive electronic device housing structure being formed on three of the four edges; and at least one electrical component with a frequency dependent impedance that is coupled between the portion of the peripheral conductive electronic device housing structure and the ground plane, the resonating element structure, the ground plane, and the at least one electrical component being configured so that the at least one electrical component exhibits a first impedance in a first communications band so that the conductive antenna structures and the at least one electrical component are operable in a closed slot antenna mode covering the first communications band and so that the at least one electrical component exhibits a second impedance that is higher than the first impedance in a second communications band so that the conductive antenna structures and the at least one electrical component are operable in an inverted-F antenna mode covering the second communications band, wherein the at least one electrical component comprises a resonant circuit that includes a capacitor and an inductor connected in parallel, and the resonating element structure, the ground plane, and the at least one electrical component surround and enclose an opening formed between the resonating element structure and the ground plane when operating in the closed slot antenna mode.

2. The antenna structures defined in claim 1 wherein the ground plane, resonating element structure, and the at least one electrical component are configured to form an inverted-F antenna when the at least one electrical component exhibits the second impedance in the second communications band, such that the at least one electrical component forms an open circuit at an end of the opening when the at least one electrical component exhibits the second impedance in the inverted-F antenna mode to form the inverted-F antenna.

3. The antenna structures defined in claim 2 wherein the conductive antenna structures and the at least one electrical component are configured to form a slot antenna when the at least one electrical component exhibits the first impedance.

4. The antenna structures defined in claim 1 wherein the conductive antenna structures and the at least one electrical component are configured to form a slot antenna when the at least one electrical component exhibits the first impedance.

5. The antenna structures defined in claim 1, wherein the electrical component bridges a gap in the peripheral conductive electronic device housing structure.

6. An electronic device having a planar surface with four peripheral edges, comprising:

radio-frequency transceiver circuitry that transmits and receives radio-frequency signals;

antenna structures that are coupled to the radio-frequency transceiver circuitry and that comprise a resonating element and ground plane structures;

first and second antenna tuning circuits coupled to the antenna structures, the antenna structures and the first and second antenna tuning circuits being configured to operate in a closed slot antenna mode at a first frequency of operation at which the first antenna tuning circuit exhibits a first impedance and being configured to operate in an inverted-F antenna mode at a second frequency of operation at which the first antenna tuning circuit exhibits a second impedance that is larger than the first impedance, wherein the resonating element, the ground plane structures, and the first and second antenna tuning circuits surround and enclose an opening between the resonating element and the ground plane structures when operating in the closed slot antenna mode; and a rectangular housing in which the radio-frequency transceiver circuitry is mounted, the rectangular housing comprising a peripheral conductive housing member that extends across each of the four peripheral edges of the electronic device to surround the electronic device, and the resonating element being formed from a portion of the peripheral conductive housing member that is formed on three of the four peripheral edges.

7. The electronic device defined in claim 6 further comprising conductive internal structures that form at least part of the ground plane structures for the inverted-F antenna, wherein the inverted-F antenna includes a main antenna resonating element branch formed at least partly from the peripheral conductive housing member.

8. A method for transmitting and receiving radio-frequency signals using radio-frequency transceiver circuitry coupled to an adjustable antenna in an electronic device having control circuitry and a peripheral conductive housing structure that surrounds four sides of the electronic device, the adjustable antenna comprising conductive antenna resonating element structures, a ground plane, and at least first and second antenna tuning elements, at least some of the conductive antenna resonating element structures being formed from the peripheral conductive housing structure, the method comprising:

transmitting and receiving radio-frequency signals in a first communications band with the radio-frequency transceiver circuitry and the adjustable antenna while the first antenna tuning element exhibits a first impedance in the first communications band so that the adjustable antenna operates in a closed slot antenna mode, the conductive antenna resonating element structures and the first and second antenna tuning elements being configured to surround and enclose an opening formed between the ground plane and the conductive antenna resonating element structures during the closed slot antenna mode; and transmitting and receiving radio-frequency signals in a second communications band with the radio-frequency transceiver circuitry and the adjustable antenna while the first antenna tuning element exhibits a second impedance in the second communications band that is greater than the first impedance so that the adjustable antenna operates in an inverted-F antenna mode, the second antenna tuning element being configured to exhibit a third impedance when the conductive antenna structures are operated in the inverted-F antenna mode and a fourth impedance that is lower than the third impedance when the conductive antenna structures are operated in the closed slot antenna mode.

* * * * *